US007856951B2

(12) United States Patent
Kamado et al.

(10) Patent No.: US 7,856,951 B2
(45) Date of Patent: Dec. 28, 2010

(54) CONTROL APPARATUS AND CONTROL METHOD FOR HYDRAULICALLY DRIVEN COOLING FAN

(75) Inventors: Mitsuhiko Kamado, Osaka (JP); Shigeru Yamamoto, Osaka (JP); Tomohiro Nakagawa, Osaka (JP)

(73) Assignee: Komatsu, Ltd., Tokyo (JP)

( * ) Notice: Subject to any disclaimer, the term of this patent is extended or adjusted under 35 U.S.C. 154(b) by 472 days.

(21) Appl. No.: 11/922,835

(22) PCT Filed: Jul. 6, 2006

(86) PCT No.: PCT/JP2006/314004

§ 371 (c)(1),
(2), (4) Date: Dec. 21, 2007

(87) PCT Pub. No.: WO2007/004750

PCT Pub. Date: Jan. 11, 2007

(65) Prior Publication Data

US 2009/0120386 A1 May 14, 2009

(30) Foreign Application Priority Data

Jul. 6, 2005 (JP) ..... 2005-197936

(51) Int. Cl.
*F01P 7/10* (2006.01)

(52) U.S. Cl. ..... 123/41.49; 123/41.11; 123/41.12; 60/493

(58) Field of Classification Search ..... 123/41.11, 123/41.12, 41.49; 60/487, 445, 465, 469, 60/489, 492, 491, 493
See application file for complete search history.

(56) References Cited

U.S. PATENT DOCUMENTS

| | | | | |
|---|---|---|---|---|
| 6,076,488 | A * | 6/2000 | Yamagishi | 123/41.12 |
| 6,349,882 | B1 * | 2/2002 | Kita et al. | 236/34 |
| 6,481,388 | B1 * | 11/2002 | Yamamoto | 123/41.12 |
| 6,750,623 | B1 | 6/2004 | McCauley et al. | |
| 6,959,671 | B2 * | 11/2005 | Nakagawa et al. | 123/41.49 |
| 2005/0183417 | A1 | 8/2005 | Nakagawa et al. | |

FOREIGN PATENT DOCUMENTS

| | | |
|---|---|---|
| JP | 2002-349262 | 4/2002 |
| JP | 2004-197682 | 7/2004 |
| JP | 2004-251120 | 9/2004 |
| JP | 2006-057601 | 2/2006 |

OTHER PUBLICATIONS

Japanese Office Action for related patent No. 2005-197936.

* cited by examiner

*Primary Examiner*—Noah Kamen
*Assistant Examiner*—Hung Q Nguyen
(74) *Attorney, Agent, or Firm*—Husch Blackwell Welsh Katz

(57) ABSTRACT

An invention relating to a control apparatus and a control method for a hydraulically driven cooling fan for reducing the peak pressure produced upon reversing the switch position of a switching valve, without stopping an engine, and without greatly modifying existing hydraulic circuitry or increasing the apparatus cost. In the invention, in the case that a reversing switch has been operated so as to output a reversal processing commencement instruction signal, control is carried out such that, under the condition that the rotational speed of the engine has decreased to not more than a stipulated rotational speed, capacity adjusting means is controlled, so as to reduce the capacity of a hydraulic pump, and thus reduce the fan rotational speed, and then the switch position of the switching valve is reversed.

7 Claims, 6 Drawing Sheets

CONTROL APPARATUS AND CONTROL METHOD FOR HYDRAULICALLY DRIVEN COOLING FAN

This application claims priority of PCT/JP2006/314004 filed Jul. 6, 2006, which is based on Japanese Patent Application Number 2005-197936 filed on Jul. 6, 2005.

TECHNICAL FIELD

The present invention relates to a control apparatus and a control method for a hydraulically driven cooling fan, and in particular relates to an apparatus and a method for controlling the switching of the direction of rotation of a hydraulically driven cooling fan.

BACKGROUND ART

Engines of construction machinery such as bulldozers and hydraulic excavators are cooled by circulating cooling water (a coolant), heat produced by the engine being dissipated when the cooling water passes through a radiator. With construction machinery, unlike with an automobile or the like, there is little opportunity for an air current caused by traveling to strike the radiator, and hence it is necessary to constantly rotate a hydraulically driven cooling fan in a forward rotational direction, thus creating an air current passing over the radiator so as to bring about heat dissipation. Note that there are also models of construction machinery having a configuration in which the hydraulically driven cooling fan is rotated so as to create an air current passing over an oil cooler, thus dissipating heat from hydraulic operating oil. In this case, the oil cooler and the radiator are installed in order along the path of the air current created by the hydraulically driven cooling fan.

In the case that the hydraulically driven cooling fan is used purely to cool the cooling water and/or operating hydraulic oil in this way, a fan that can only be rotated in the forward rotational direction may be used.

However, upon the radiator or oil cooler being used for a long time, clogging with rubbish may occur, and hence the cooling performance may be impaired.

Accordingly, from hitherto, hydraulic circuitry as shown in FIG. 6 has been constructed, so that rubbish can be removed using the hydraulically driven cooling fan. In FIG. 6, the oil cooler is omitted, a configuration in which only the radiator is cooled being shown.

That is, as shown in FIG. 6, there are provided a hydraulic pump 18 that is driven by an engine 4, a hydraulic motor 15 that is driven by hydraulic oil ejected from the hydraulic pump 18 and rotates in a forward rotational direction or a reverse rotational direction in accordance with the direction of the supplied hydraulic oil, a hydraulically driven cooling fan 13 that is driven by the hydraulic motor 15, and a switching valve 220.

Upon the switching valve 220 being switched to a forward rotation position, the hydraulic oil ejected from the hydraulic pump 18 is supplied via an oil line 19*a* and the switching valve 220 to a port MA of the hydraulic motor 15, and is discharged from a port MB of the hydraulic motor 15 via the switching valve 220 and an oil line 19*b* into a reservoir 21. Consequently, the hydraulic motor 15 rotates in the forward rotational direction, and hence the hydraulically driven cooling fan 13 rotates in the forward rotational direction. As a result, an air current cooling a radiator 12 is created, and hence heat is dissipated from cooling water passing through the radiator 12.

On the other hand, upon the switching valve 220 being switched to a reverse rotation position, the hydraulic oil ejected from the hydraulic pump 18 is supplied via the oil line 19*a* and the switching valve 220 to the port MB of the hydraulic motor 15, and is discharged from the port MA of the hydraulic motor 15 via the switching valve 220 and the oil line 19*b* into the reservoir 21. Consequently, the hydraulic motor 15 rotates in the reverse rotational direction, and hence the hydraulically driven cooling fan 13 rotates in the reverse rotational direction. As a result, an air current blowing out rubbish from the radiator 12 is created, and hence rubbish clogging the radiator 12 is blown out.

However, in a state in which the hydraulic oil is being ejected from the hydraulic pump 18 into the oil line 19*a* at a large flow rate and a high pressure so that the hydraulically driven cooling fan 13 is rotating at a high rotational speed, if the switch position of the switching valve 220 is reversed, then cavitation arises in the oil line during the switching, and hence the peak pressure of the hydraulic oil flowing through the oil line rises. As a result, the hydraulic equipment is subjected to an excessive load, which may affect the durability of the hydraulic equipment. Moreover, the hydraulically driven cooling fan 13 reverses while maintaining a high rotational speed, and hence the fan produces much noise upon the reversal, giving an operator an unpleasant or incongruous feeling. An abnormal noise may also be produced by other hydraulic equipment upon the reversal, again giving the operator an unpleasant or incongruous feeling.

The higher the rotational speed of the engine 4, and hence the higher the rotational speed of the hydraulically driven cooling fan 13, or the lower the oil temperature, the higher the peak pressure becomes, and hence the greater the effect on the durability of the hydraulic equipment, and the greater the effect on the operator.

To prevent this situation, various art for reducing the peak pressure produced upon reversing the switch position of the switching valve has thus been proposed from hitherto.

(Prior Art Seen in Patent Document)

A cited patent document is Japanese Patent Application Laid-open No. 2002-349262.

(Prior Art 1)

First, in the "Problem to be Solved" section in the patent document, there is described an invention in which the switching valve 220 shown in FIG. 6 is constructed as a 2-position switching valve having a forward rotation position and a reverse rotation position but not having a neutral position, and when the switch position of the switching valve 220 is reversed, the engine 4 and the hydraulically driven cooling fan 13 are temporarily stopped.

(Prior Art 2)

In the "Working Examples" section in the patent document, there is described an invention in which the switching valve 220 shown in FIG. 6 is constructed as a 2-position switching valve having a forward rotation position and a reverse rotation position but not having a neutral position, in addition to this switching valve 220 there is separately provided a rotation-stopping switching valve for stopping the rotation of the hydraulically driven cooling fan 13, and when the switch position of the switching valve 220 is reversed, the rotation-stopping switching valve is switched, so as to temporarily stop the rotation of the hydraulically driven cooling fan 13.

(Prior Art 3)

Furthermore, in the "Working Examples" section in the patent document, there is described an invention in which the switching valve 220 shown in FIG. 6 is constructed as a 3-position switching valve provided with a neutral position in which the oil line 19*a* and the oil line 19*b* are communicated together (a fan-stopping position) between the forward rotation position and the reverse rotation position, and when the switch position of the switching valve 220 is to be reversed, the switching valve 220 is first positioned in the neutral position (the fan-stopping position), so as to temporarily stop the rotation of the hydraulically driven cooling fan 13.

According to prior art 1 described above, the engine 4 stops each time the switch position of the switching valve 220 is reversed, and hence each time an operation of restarting the engine 4 is required. Operation is thus burdensome for the operator, and moreover the work efficiency is greatly impaired.

According to prior art 2 described above, there is no need to stop the engine 4 each time the switch position of the switching valve 220 is reversed, and hence the problem of prior art 1 is resolved; however, a rotation-stopping switching valve must be provided in addition to the switching valve 220, and hence existing hydraulic circuitry must be modified, and the apparatus cost increases.

According to prior art 3 described above, there is no need to stop the engine 4 each time the switch position of the switching valve 220 is reversed, and hence the problem of prior art 1 is resolved; however, the switching valve 220 must be constructed as a 3-position switching valve, for which the construction of the valve itself and a control apparatus is more complex than for a 2-position switching valve, and hence the apparatus cost increases.

DISCLOSURE OF THE INVENTION

In view of the above state of affairs, it is an object of the present invention to reduce the peak pressure produced upon reversing the switch position of a switching valve, without stopping an engine, and without greatly modifying existing hydraulic circuitry or increasing the apparatus cost.

Accordingly, a first aspect of the present invention is characterized by being a hydraulically driven cooling fan control apparatus comprising:

a hydraulic pump that is driven by an engine;

a hydraulic motor that is driven by hydraulic oil ejected from the hydraulic pump, and rotates in a forward rotational direction or a reverse rotational direction in accordance with a direction of the supplied hydraulic oil;

capacity adjusting means for adjusting a capacity of the hydraulic pump or the hydraulic motor;

a hydraulically driven cooling fan that is driven by the hydraulic motor;

a switching valve that has a forward rotation position and a reverse rotation position, and upon being switched to the forward rotation position, supplies the hydraulic oil ejected from the hydraulic pump in a direction corresponding to the forward rotational direction of the hydraulic motor, and upon being switched to the reverse rotation position, supplies the hydraulic oil ejected from the hydraulic pump in a direction corresponding to the reverse rotational direction of the hydraulic motor;

a reversing switch that is operated to reverse a switch position of the switching valve, and outputs a reversal processing commencement instruction signal; and control means for, in response to input of the reversal processing commencement instruction signal, and under a condition that a rotational speed of the engine has decreased to not more than a stipulated rotational speed, controlling the capacity adjusting means, so as to reduce the capacity of the hydraulic pump or the hydraulic motor, and thus reduce a rotational speed of the hydraulically driven cooling fan, and then reversing the switch position of the switching valve.

A second aspect of the present invention is characterized by being a hydraulically driven cooling fan control apparatus comprising:

a hydraulic pump that is driven by an engine;

a hydraulic motor that is driven by hydraulic oil ejected from the hydraulic pump, and rotates in a forward rotational direction or a reverse rotational direction in accordance with a direction of the supplied hydraulic oil;

a hydraulically driven cooling fan that is driven by the hydraulic motor;

a switching valve that has a forward rotation position and a reverse rotation position, and upon being switched to the forward rotation position, supplies the hydraulic oil ejected from the hydraulic pump in a direction corresponding to the forward rotational direction of the hydraulic motor, and upon being switched to the reverse rotation position, supplies the hydraulic oil ejected from the hydraulic pump in a direction corresponding to the reverse rotational direction of the hydraulic motor;

a reversing switch that is operated to reverse a switch position of the switching valve, and outputs a reversal processing commencement instruction signal; and control means for, in response to input of the reversal processing commencement instruction signal, and under conditions that a rotational speed of the engine has decreased to not more than a stipulated rotational speed, and a rotational speed of the hydraulically driven cooling fan has decreased to a desired rotational speed, reversing the switch position of the switching valve.

A third aspect of the present invention is characterized by being a hydraulically driven cooling fan control apparatus comprising:

engine rotational speed adjusting means for adjusting a rotational speed of an engine;

a hydraulic pump that is driven by the engine;

a hydraulic motor that is driven by hydraulic oil ejected from the hydraulic pump, and rotates in a forward rotational direction or a reverse rotational direction in accordance with a direction of the supplied hydraulic oil;

capacity adjusting means for adjusting a capacity of the hydraulic pump or the hydraulic motor;

a hydraulically driven cooling fan that is driven by the hydraulic motor;

a switching valve that has a forward rotation position and a reverse rotation position, and upon being switched to the forward rotation position, supplies the hydraulic oil ejected from the hydraulic pump in a direction corresponding to the forward rotational direction of the hydraulic motor, and upon being switched to the reverse rotation position, supplies the hydraulic oil ejected from the hydraulic pump in a direction corresponding to the reverse rotational direction of the hydraulic motor; and control means for controlling the engine rotational speed adjusting means, so as to reduce the rotational speed of the engine to not more than a stipulated rotational speed, and controlling the capacity adjusting means, so as to reduce the capacity of the hydraulic pump or the hydraulic motor, and thus reduce a rotational speed of the hydraulically driven cooling fan to a desired rotational speed, and then reversing a switch position of the switching valve.

A fourth aspect of the present invention is characterized in that, in the case of the third aspect, the control means carries out control such that a value of the desired rotational speed of the hydraulically driven cooling fan is further reduced as an oil temperature value becomes lower.

A fifth aspect of the present invention is characterized in that, in the case of the fourth aspect, the control means adjusts the stipulated rotational speed of the engine to a lower value as the oil temperature value becomes lower.

A sixth aspect of the present invention is characterized by being a method for controlling a hydraulically driven cooling fan that is rotationally driven by supplying hydraulic oil from a hydraulic pump having an engine as a driving source to a hydraulic motor via a switching valve, the hydraulically driven cooling fan control method comprising:

a step of, upon an instruction for reversing a switch position of the switching valve being given, and under a condition that a rotational speed of the engine is not more than a stipulated rotational speed, adjusting a capacity of the hydraulic pump or the hydraulic motor, so as to reduce the capacity of the hydraulic pump or the hydraulic motor, and thus reduce a rotational speed of the hydraulically driven cooling fan; and a step of, once the rotational speed of the hydraulically driven cooling fan has been reduced to a desired rotational speed, reversing the switch position of the switching valve.

A seventh aspect of the present invention is characterized by being a method for controlling a hydraulically driven cooling fan that is rotationally driven by supplying hydraulic oil from a hydraulic pump having an engine as a driving source to a hydraulic motor via a switching valve, the hydraulically driven cooling fan control method comprising:

a step of, upon an instruction for reversing a switch position of the switching valve being given, adjusting a rotational speed of the engine so as to reduce the rotational speed of the engine to not more than a stipulated rotational speed, and adjusting a capacity of the hydraulic pump or the hydraulic motor, so as to reduce the capacity of the hydraulic pump or the hydraulic motor, and thus reduce a rotational speed of the hydraulically driven cooling fan; and a step of, once the rotational speed of the hydraulically driven cooling fan has been reduced to a desired rotational speed, reversing the switch position of the switching valve.

For the first aspect of the invention, as shown in FIG. 3, when a reversing switch 30 is operated so that a reversal processing commencement instruction signal is outputted, control is carried out in which, under the condition that the rotational speed Ne of an engine 4 has decreased to not more than a stipulated rotational speed, capacity adjusting means 9 is controlled, so as to reduce the capacity of a hydraulic pump 18, and thus reduce the fan rotational speed N, and then the switch position of a switching valve 20 is reversed.

According to the first aspect of the invention, in addition to the engine rotational speed Ne being reduced, the capacity of the hydraulic pump 18 is also reduced to a minimum, so as to sufficiently reduce the fan rotational speed N, and then switching of the switching valve 20 is carried out. As a result, the effect of suppressing the peak pressure is large, and hence even in the case, for example, that the oil temperature is low, the peak pressure can be suppressed sufficiently.

Moreover, according to the first aspect of the invention, there is no need to separately add a new valve or control apparatus to existing hydraulic circuitry (FIG. 6), and a 2-position switching valve is adequate for the switching valve 220 (FIG. 6) with there being no need to use a 3-position switching valve; it is sufficient to merely modify a control program installed in a controller 24 (which is naturally provided even in an existing system) as shown in FIG. 3. The increase in the apparatus cost can thus be kept to a minimum. Moreover, the engine 4 is of course not stopped during switching of the switching valve 20, and hence there is no burdensomeness of having to restart the engine.

The cost can be reduced particularly in the case that the switching valve 20 is constructed as a 2-position switching valve having a forward rotation position 20A and a reverse rotation position 20B but not having a neutral position as shown in FIG. 1.

In an exemplary embodiment of the first aspect of the invention, as shown in FIG. 2A, the reversing switch 30 is constructed as a switch for selecting first reversal processing in which the switching valve 20 is switched from the forward rotation position 20A to the reverse rotation position 20B, and second reversal processing in which the switching valve 20 is switched from the reverse rotation position 20B to the forward rotation position 20A, and as shown in parts (a) and (b) of FIG. 4, the controller 24 implements the first reversal processing upon the reversing switch 30 being operated to select the first reversal processing, and implements the second reversal processing upon the reversing switch 30 being operated to select the second reversal processing.

In an exemplary embodiment of the first aspect of the invention, as shown in FIG. 2B, the reversing switch 30 is constructed as a switch that instructs reversal processing of switching the switching valve 20 from the forward rotation position 20A to the reverse rotation position 20B, and then from the reverse rotation position 20B to the forward rotation position 20A, and as shown in parts (a) and (c) of FIG. 4, upon the reversing switch 30 being operated to instruct the reversal processing, the controller 24 implements reversal processing in which the switching valve 20 is reversed from the forward rotation position 20A to the reverse rotation position 20B, and is then reversed from the reverse rotation position 20B to the forward rotation position 20A.

For the fourth aspect of the invention, the controller 24 carries out control such that the lower the oil temperature value Th, the more the rotational speed N of the hydraulically driven cooling fan 13 is reduced at times when the switch position of the switching valve 20 is reversed (t3 and t8 in part (a) of FIG. 4), whereby the fan rotational speed N is reduced to the minimum required, so that the peak pressure is reduced reliably.

In an exemplary embodiment of the fourth aspect of the invention, the lower the oil temperature value Th, the lower the capacity q of the hydraulic pump 18 is adjusted to be. As shown in FIG. 5A, in the case that the oil temperature Th is a high value Th1, the fan rotational speed N is controlled to be a high value N1 by adjusting the capacity q of the hydraulic pump 18 to a high value q1, and then the reversal is carried out. On the other hand, in the case that the oil temperature Th is a low value Th2, the fan rotational speed N is controlled to be a low value N2 by adjusting the capacity q of the hydraulic pump 18 to a low value q2 (<q1), and then the reversal is carried out.

In an exemplary embodiment of the fourth aspect of the invention, the lower the oil temperature value Th, the longer is made a deceleration time $\tau$ over which the rotational speed N of the hydraulically driven cooling fan 13 is reduced from reversal processing being commenced (the pre-reversal deceleration period; time t1-t2 or t9-t10 in part (a) of FIG. 4). As shown in FIG. 5B, in the case that the oil temperature Th is a high value Th1, the fan rotational speed N is controlled to be a high value N1 by setting the pre-reversal deceleration period $\tau$ to be a short period $\tau$1, and then the reversal is carried out. On the other hand, in the case that the oil temperature Th is a low value Th2, the fan rotational speed N is controlled to be a low value N2 by setting the pre-reversal deceleration period τ to be a long period τ2 (>τ1), and then the reversal is carried out.

For the second aspect of the invention, control of adjusting the capacity of the hydraulic pump 18 in the first embodiment is omitted. That is, upon the reversing switch 30 being operated so as to instruct selection of reversal processing, under the conditions that the engine rotational speed Ne has decreased to not more than a stipulated rotational speed and the rotational speed N of the hydraulically driven cooling fan 13 has decreased, the switch position of the switching valve 20 is reversed.

In an exemplary embodiment of the second aspect of the invention, the condition that the engine rotational speed Ne has decreased to not more than a stipulated rotational speed is omitted. That is, upon the reversing switch 30 being operated so as to instruct selection of reversal processing, the capacity adjusting means 9 is controlled, so as to reduce the capacity of the hydraulic pump 18 (e.g. adjust to a minimum capacity), and thus reduce the rotational speed N of the hydraulically driven cooling fan 13, and then the switch position of the switching valve 20 is reversed.

In an exemplary embodiment of the second aspect of the invention, the control to reduce the engine rotational speed Ne to not more than the stipulated rotational speed is carried out automatically. That is, upon the reversing switch 30 being operated so as to instruct selection of reversal processing, engine rotational speed adjusting means 7 is controlled, so as to reduce the rotational speed Ne of the engine 4 to not more than the stipulated rotational speed, and moreover the capacity adjusting means 9 is controlled, so as to reduce the capacity of the hydraulic pump 18 (e.g. adjust to a minimum capacity), and thus reduce the rotational speed N of the hydraulically driven cooling fan 13, and then the switch position of the switching valve 20 is reversed.

In an exemplary embodiment of the second aspect of the invention, the control of adjusting the capacity of the hydraulic pump 18 is further omitted. That is, upon the reversing switch 30 being operated so as to instruct selection of reversal processing, the engine rotational speed adjusting means 7 is controlled, so as to reduce the rotational speed Ne of the engine 4 to not more than a stipulated rotational speed, and thus reduce the rotational speed N of the hydraulically driven cooling fan 13, and then the switch position of the switching valve 20 is reversed.

For the third aspect of the invention, operating the reversing switch 30 is further made unnecessary. For example periodically or every time an event occurs, the engine rotational speed adjusting means 7 is controlled, so as to reduce the rotational speed Ne of the engine 4 to not more than a stipulated rotational speed, and moreover the capacity adjusting means 9 is controlled, so as to reduce the capacity of the hydraulic pump 18 (e.g. set the capacity to a minimum capacity), and thus reduce the rotational speed N of the hydraulically driven cooling fan 13, and then the switch position of the switching valve 20 is reversed.

In an exemplary embodiment of the third aspect of the invention, the control of adjusting the capacity of the hydraulic pump 18 is omitted. That is, for example periodically or every time an event occurs, the engine rotational speed adjusting means 7 is controlled, so as to reduce the rotational speed Ne of the engine 4 to not more than a stipulated rotational speed, and thus reduce the rotational speed N of the hydraulically driven cooling fan 13, and then the switch position of the switching valve 20 is reversed.

In an exemplary embodiment of the third aspect of the invention, the control of reducing the engine rotational speed Ne to not more than a stipulated rotational speed is omitted. That is, for example periodically or every time an event occurs, the capacity adjusting means 9 is controlled, so as to reduce the capacity of the hydraulic pump 18 (e.g. set the capacity to a minimum capacity), and thus reduce the rotational speed N of the hydraulically driven cooling fan 13, and then the switch position of the switching valve 20 is reversed.

The above third aspect of the invention is a working example in which control is carried out automatically to reduce the rotational speed Ne of the engine 4 to not more than a stipulated rotational speed.

In the fifth aspect of the invention, when implementing these aspects of the invention, the stipulated engine rotational speed to be reduced to is changed, so as to change the fan rotational speed N, in accordance with the oil temperature Th. That is, as shown in FIG. 5C, in the case that the oil temperature Th is a high value Th1, the engine rotational speed Ne is adjusted to a high stipulated rotational speed Ne1, so as to control the fan rotational speed N to a high value N1, and then the reversal is carried out. On the other hand, in the case that the oil temperature Th is a low value Th2, the engine rotational speed Ne is adjusted to a low stipulated rotational speed Ne2 (<Ne1), so as to control the fan rotational speed N to a low value N2, and then the reversal is carried out.

The sixth aspect of the invention is a control method invention corresponding to the apparatus invention of the first aspect.

The seventh aspect of the invention is a control method invention corresponding to the apparatus invention of the third aspect.

Figure 4:
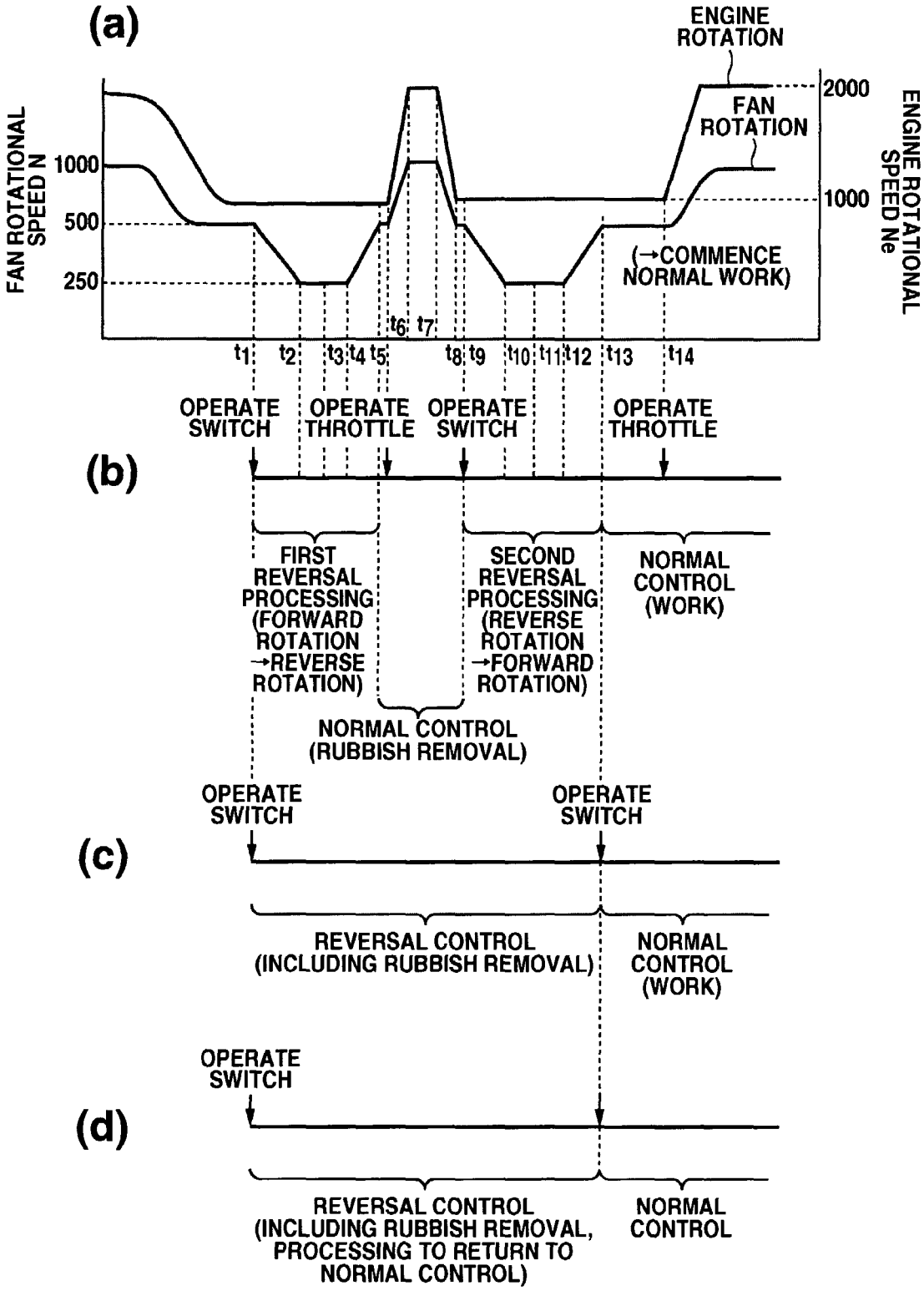
Figure 5A:
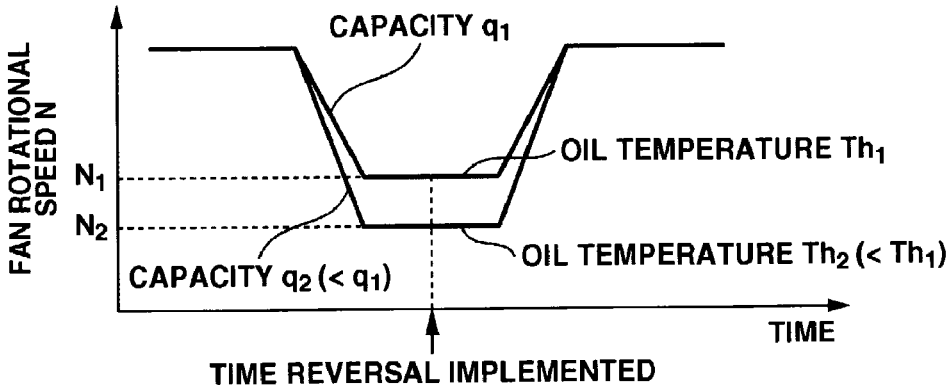
Figure 5B:
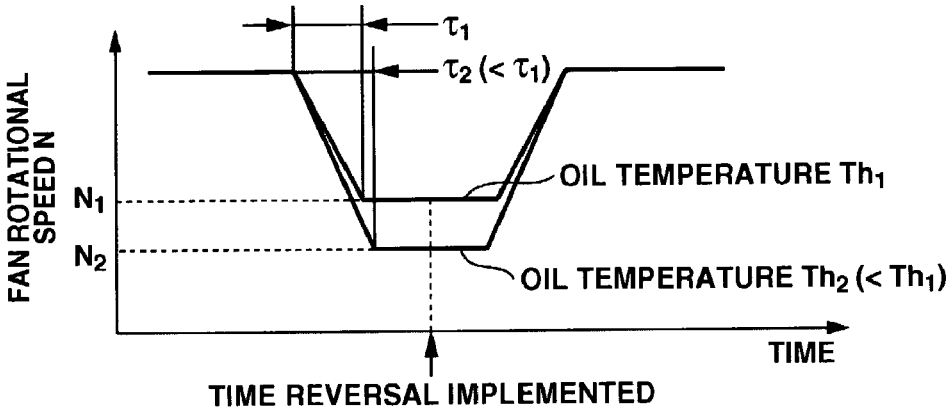
Figure 5C:
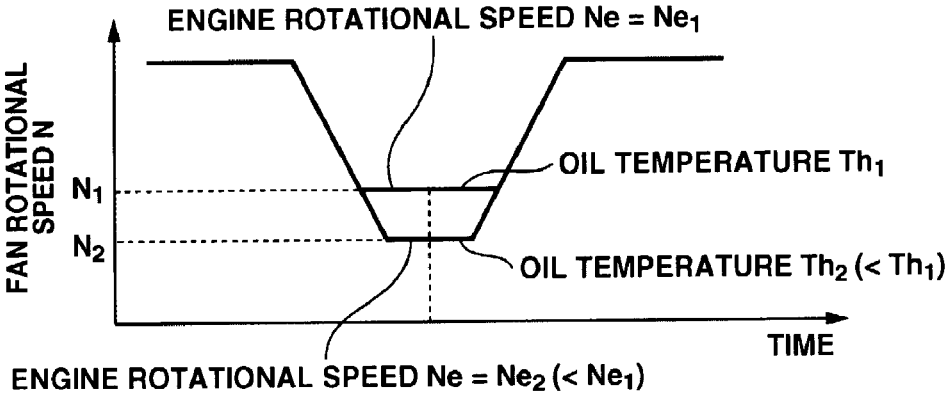
Figure 6:
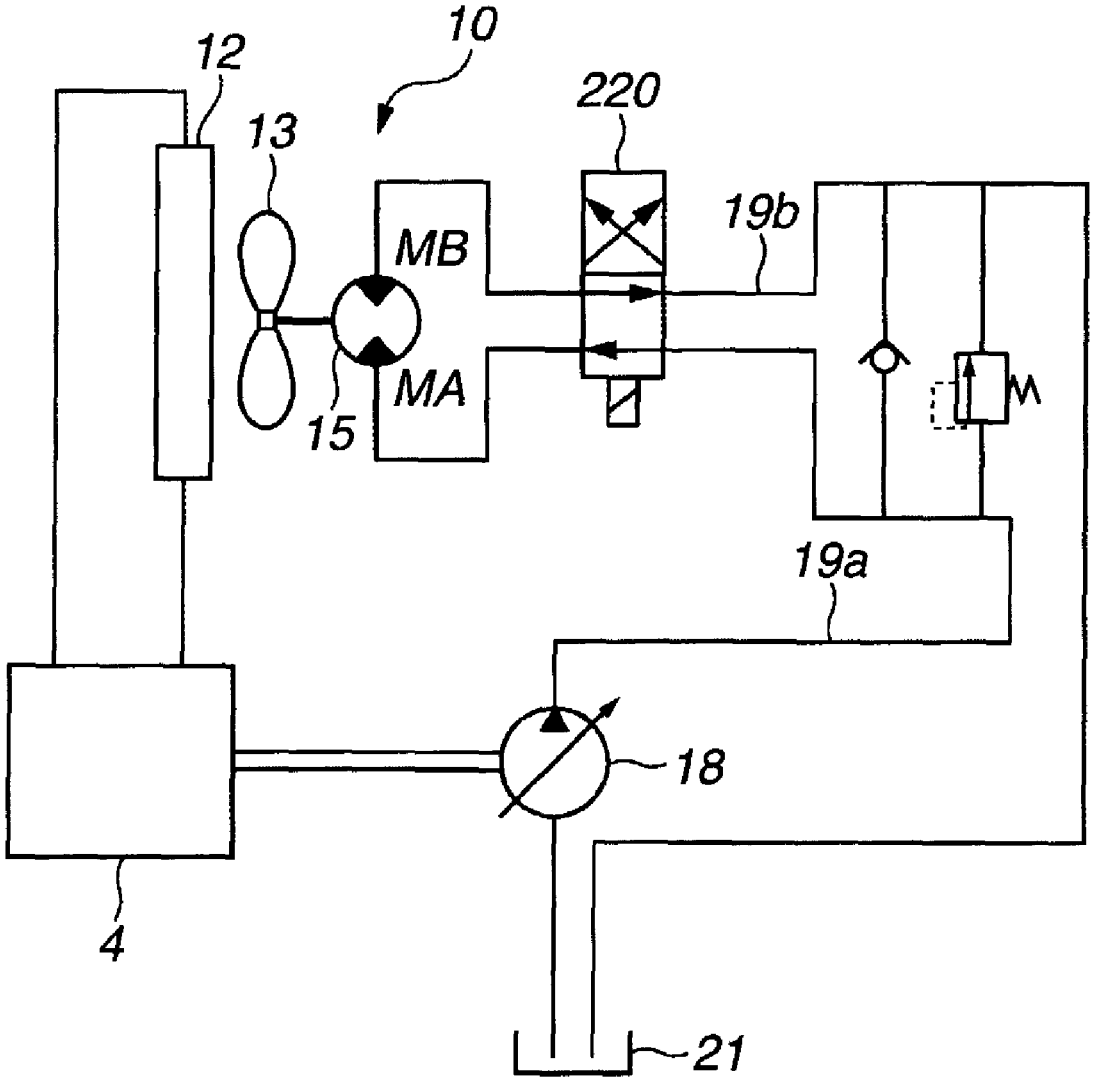
FIG.6 (PRIOR ART)

Parts (a) to (d) of FIG. 4 are diagrams showing operation according to working examples as a time chart;

FIGS. 5A and 5B are diagrams illustrating cases that a hydraulic pump capacity or a fan deceleration period are changed in accordance with oil temperature so as to change a fan rotational speed during reversal, and FIG. 5C is a diagram illustrating a case that an engine rotational speed is changed in accordance with the oil temperature so as to change the fan rotational speed during reversal; and FIG. 6 is a diagram for explaining prior art, being a diagram showing existing hydraulic circuitry.

BEST MODE FOR CARRYING OUT THE INVENTION

Following is a description of embodiments of the present invention with reference to the drawings.

Note that in the following, description is given assuming construction machinery such as a bulldozer or a hydraulic excavator, but the target of application of the present invention, i.e. the vehicle equipped with the apparatus of the present invention is not limited to being construction machinery.

Figure 1:
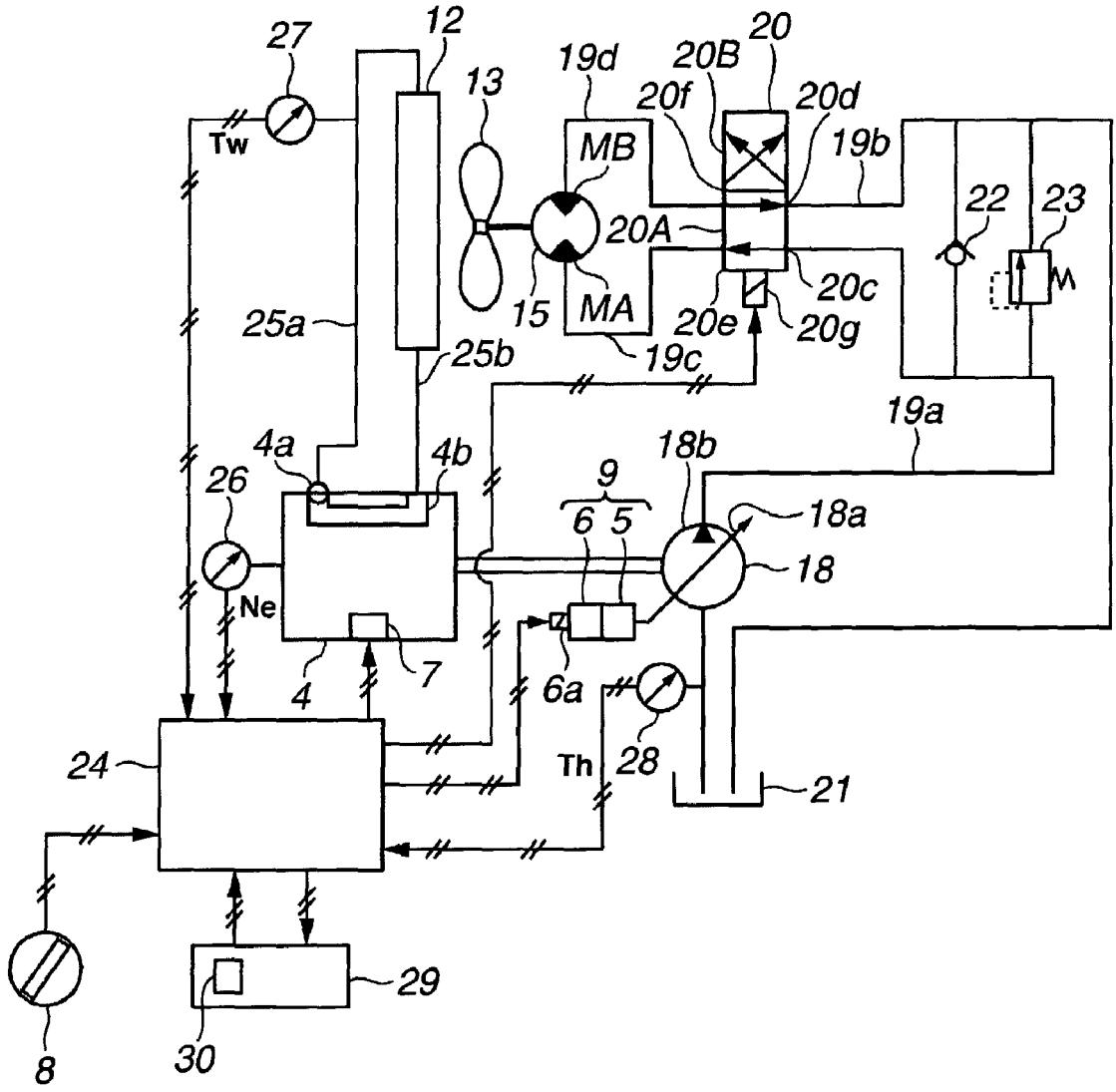
FIG. 1 is a hydraulic circuit diagram according to an embodiment of the present invention.

FIG. 1 shows hydraulic circuitry according to a working example. In FIG. 1, an oil cooler is omitted, a configuration in which only a radiator 12 is cooled being shown.

That is, as shown in FIG. 1, principal hydraulic equipment comprises a variable displacement hydraulic pump 18 that is driven by an engine 4, a fixed displacement hydraulic motor 15 which is a hydraulic motor driven by hydraulic oil ejected from the variable displacement hydraulic pump 18 and which rotates in a forward rotational direction or a reverse rotational direction in accordance with which of two ports MA and MB has the hydraulic oil supplied thereto, a hydraulically driven cooling fan 13 that is driven by the fixed displacement hydraulic motor 15, and a switching valve 20 that, upon being switched to a forward rotation position 20A, supplies the hydraulic oil ejected from the hydraulic pump 18 to a port in a direction corresponding to the forward rotational direction of the hydraulic motor 15 (the port MA), and upon being switched to a reverse rotation position 20B, supplies the hydraulic oil ejected from the hydraulic pump 18 to a port in a direction corresponding to the reverse rotational direction of the hydraulic motor 15 (the port MB).

The switching valve 20 is an electromagnetic switching valve that operates in accordance with electrical control signals applied to an electromagnetic solenoid 20*g*, and is a 2-position switching valve having only the forward rotation position 20A and the reverse rotation position 20B, i.e. not having a neutral position.

An output shaft of the engine 4 is linked to a drive shaft of the hydraulic pump 18. Note also that, although omitted from FIG. 1, in the construction machinery, in addition to the fan driving hydraulic motor 15 described above, there are also implement hydraulic actuators (hydraulic cylinders) such as a tilting cylinder and a lifting cylinder, and traveling hydraulic actuators (hydraulic motors) for making left and right crawler belts travel. Hydraulic pumps for operating these implement hydraulic actuators and traveling hydraulic actuators also have a drive shaft thereof linked to the engine 4.

A swash plate 18*a* of the hydraulic pump 18 is driven and controlled by a swash plate driving unit 5 and an electromagnetic proportional control valve 6. The swash plate driving unit 5 and the electromagnetic proportional control valve 6 constitute capacity adjusting means 9 for adjusting the capacity (cc/rev) of the hydraulic pump 18. That is, upon an electrical control signal being applied to an electromagnetic solenoid 6*a* of the electromagnetic proportional control valve 6, the electromagnetic proportional control valve 6 leads a pilot pressure depending on the electrical control signal to the swash plate driving unit 5. The swash plate driving unit 5 drives the swash plate 18*a* of the hydraulic pump 18 in accordance with the supplied pilot pressure, thus changing the capacity (cc/rev) of the hydraulic pump 18.

An ejection port 18*b* of the hydraulic pump 18 is communicated with an oil line 19*a*. The oil line 19*a* is communicated with a pump port 20*c* of the switching valve 20. A reservoir port 20*d* of the switching valve 20 is communicated with an oil line 19*b*. The oil line 19*b* is communicated with a reservoir 21.

A check valve 22 that allows flow of the hydraulic oil in only the direction from the oil line 19*b* to the oil line 19*a* is provided between the oil line 19*a* and the oil line 19*b*. The check valve 22 functions as a suction valve. That is, when the hydraulic oil ceases to be supplied from the hydraulic pump 18 to either the port MA or MB of the hydraulic motor 15, the hydraulic motor 15 continues to rotate through the driving force received from the load or the inertia of the hydraulic motor 15 itself, producing a pumping action. The oil line 19*b* thus becomes at a higher pressure than the oil line 19*a*, and hence the high-pressure hydraulic oil is led from the oil line 19*b* via the check valve 22 into the oil line 19*a*, and sucked into the port MA of the hydraulic motor 15.

Moreover, on the oil line 19*a* there is provided a relief valve 23 that relieves the hydraulic oil in the oil line 19*a* into the reservoir 21 via the oil line 19*b* if the hydraulic oil in the oil line 19*a* exceeds a set relief pressure.

One input/output port 20*e* of the switching valve 20 is communicated to one port MA of the hydraulic motor 15 via an oil line 19*c*. Another input/output port 20*f* of the switching valve 20 is communicated to the other port MB of the hydraulic motor 15 via an oil line 19*d*.

A drive shaft of the hydraulic motor 15 is linked to a rotating shaft of the hydraulically driven cooling fan 13.

The radiator 12 is disposed in a position facing the hydraulically driven cooling fan 13.

A water jacket 4*b* is formed in the engine 4 as a circulation path for cooling water (a coolant). The water jacket 4*b* is provided with a water pump 4*a* that force feeds the cooling water. An outlet of the water pump 4*a* is communicated with a water line 25*a* that is outside the engine 4. The water line 25*a* is communicated with an inlet of the radiator 12. An outlet of the radiator 12 is communicated with a water line 25*b* that is outside the engine 4. The water line 25*b* is communicated to the water jacket 4*b*. Cooling water that has become hot in the water jacket 4*b* is thus force fed into the water line 25*a* by the water pump 4*a* and hence led to the radiator 12, and is cooled by an air current created by the hydraulically driven cooling fan 13. The cooling water that has been cooled in the radiator 12 is then returned back into the water jacket 4*b* via the water line 25*b*.

Note that, like the radiator 12, an oil cooler for cooling hydraulic oil may also be disposed in a position facing the hydraulically driven cooling fan 13.

The engine 4 is provided with engine rotational speed adjusting means 7 for adjusting the rotational speed of the engine 4 to a target rotational speed. The engine rotational speed adjusting means 7 is constructed from a governor or the like. Upon an electrical control signal being applied to the engine rotational speed adjusting means 7, the engine rotational speed adjusting means 7 adjusts the rotational speed of the engine 4 to the target rotational speed in accordance with the electrical control signal.

The engine 4 is provided with an engine rotational speed detecting sensor 26 that detects the rotational speed Ne (r/min) of the engine 4.

The water line 25*a* has provided therein a cooling water temperature sensor 27 that detects the temperature Tw (° C.) of the cooling water.

The reservoir 21 has provided therein a hydraulic operating oil temperature sensor 28 that detects the temperature Th (° C.) of the hydraulic operating oil (i.e. the oil temperature).

A driver's cab of the construction machinery has an engine rotational speed setting instrument 8 (throttle dial) provided therein. The engine rotational speed setting instrument 8 is a setting instrument for setting the target rotational speed of the engine 4. Upon the engine rotational speed setting instrument 8 being operated, a signal for the engine target rotational speed having a magnitude depending on the operated position of the engine rotational speed setting instrument 8 is outputted.

The driver's cab of the construction machinery has a monitor panel 29 provided therein. As described later with reference to FIGS. 2A to 2C, the monitor panel 29 is provided with a reversing switch 30 for reversing a switch position of the switching valve 20. Upon the reversing switch 30 being operated, a reversal processing commencement instruction signal instructing reversal processing, described below, to be commenced is outputted.

A controller 24 is control means constructed from a CPU, a ROM, a RAM, and so on. Into an input board of the controller 24 are inputted detected signals from the engine rotational speed detecting sensor 26, the cooling water temperature sensor 27, and the hydraulic operating oil temperature sensor 28, and also a signal indicating the engine target rotational speed outputted from the engine rotational speed setting instrument 8, and moreover the reversal processing commencement instruction signal outputted from the reversing switch 30 (the monitor panel 29).

The ROM of the controller 24 has installed therein a control program for implementing "normal control", described below, and the "reversal processing". Moreover, the controller 24 also has built therein a software timer required when implementing the "reversal processing".

In the CPU of the controller 24, the control program is implemented, and electrical control signals for driving each of the capacity adjusting means 9 (the swash plate driving unit 5 and the electromagnetic proportional control valve 6), the engine rotational speed adjusting means 7, and the switching valve 20 are produced. The produced electrical control signals are outputted from an output board of the controller 24 to the capacity adjusting means 9 (the swash plate driving unit 5 and the electromagnetic proportional control valve 6), the engine rotational speed adjusting means 7, and the switching valve 20 respectively. The rotational speed N of the hydraulically driven cooling fan 13 is calculated by the controller 24 based on the value of the electrical control signal outputted to the capacity adjusting means 9.

Figure 2A:
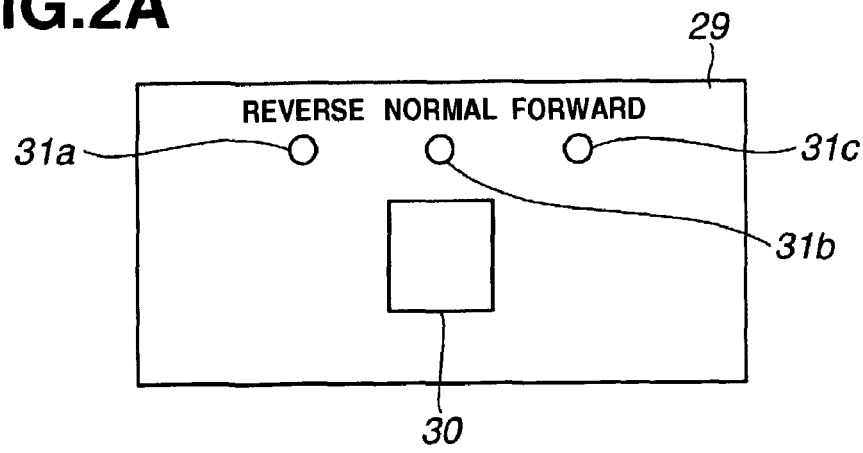
FIGS. 2A to 2C are drawings showing examples of the configuration of a reversing switch on a monitor panel.

FIG. 2A shows an example of the configuration of the reversing switch 30 provided on the monitor panel 29.

The reversing switch 30 in FIG. 2A is a switch for which selected instruction content is switched "first reversal processing→normal→control second reversal processing→normal control→first reversal processing" in accordance with the number of times the reversing switch 30 is operated (e.g. the number of times pressed).

Reversal processing in which the switching valve 20 is switched from the forward rotation position 20A to the reverse rotation position 20B (here referred to as the "first reversal processing"), normal control, and reversal processing in which the switching valve 20 is switched from the reverse rotation position 20B to the forward rotation position 20A (here referred to as the "second reversal processing") are selected in this order in accordance with the number of times that the reversing switch 30 is operated. Moreover, indicators 31*a*, 31*b*, and 31*c* that light up to display which operational state the reversing switch 30 is in may also be provided on the monitor panel 29.

When the reversing switch 30 has been operated so as to instruct selection of the first reversal processing, an "in reverse operation" indicator 31*a* indicating that selection of the first reversal processing has been instructed lights up. When the reversing switch 30 has been operated so as to instruct selection of normal control, a "normal" indicator 31*b* indicating that selection of normal control has been instructed lights up. When the reversing switch 30 has been operated so as to instruct selection of the second reversal processing, an "in forward operation" indicator 31*c* indicating that selection of the second reversal processing has been instructed lights up.

When the reversing switch 30 has been operated so as to instruct selection of the first reversal processing or the second reversal processing, the reversal processing commencement instruction signal is outputted, and when the reversing switch 30 has been operated so as to instruct selection of normal control, the reversal processing commencement instruction signal is turned off.

Upon an electrical control signal for carrying out the first reversal processing being outputted from the controller 24 and inputted to the electromagnetic solenoid 20*g* of the switching valve 20, the switching valve 20 is switched from the forward rotation position 20A to the reverse rotation position 20B. Upon the switching valve 20 being switched to the reverse rotation position 20B, the hydraulic oil ejected from the hydraulic pump 18 is supplied via the oil line 19*a*, the pump port 20*c* of the switching valve 20, the input/output port 20*f*, and the oil line 19*d* to the port MB of the hydraulic motor 15, and is discharged from the port MA of the hydraulic motor 15 via the oil line 19*c*, the input/output port 20*e* of the switching valve 20, the reservoir port 20*d*, and the oil line 19*b* to the reservoir 21. Consequently, the hydraulic motor 15 rotates in the reverse rotational direction, and hence the hydraulically driven cooling fan 13 rotates in the reverse rotational direction. As a result, an air current blowing out rubbish from the radiator 12 is created, and hence rubbish clogging the radiator 12 is blown out.

Upon an electrical control signal for carrying out the second reversal processing being outputted from the controller 24 and inputted to the electromagnetic solenoid 20*g* of the switching valve 20, the switching valve 20 is switched from the reverse rotation position 20B to the forward rotation position 20A. Upon the switching valve 20 being switched to the forward rotation position 20A, the hydraulic oil ejected from the hydraulic pump 18 is supplied via the oil line 19*a*, the pump port 20*c* of the switching valve 20, the input/output port 20*e*, and the oil line 19*c* to the port MA of the hydraulic motor 15, and is discharged from the port MB of the hydraulic motor 15 via the oil line 19*d*, the input/output port 20*f* of the switching valve 20, the reservoir port 20*d*, and the oil line 19*b* to the reservoir 21. As a result, an air current cooling the radiator 12 is created, and hence heat is dissipated from the cooling water passing through the radiator 12.

Next, the contents of the "normal control" will be described.

A target temperature of the cooling water is set to a temperature at which the efficiency of the engine 4 is optimum. The temperature of the cooling water is changed by adjusting the rotational speed N of the hydraulically driven cooling fan 13 (hereinafter referred to as the "fan rotational speed N"). The temperature of the cooling water is controlled to the target temperature by adjusting the fan rotational speed N in accordance with the actual oil temperature Th, the actual temperature Tw of the cooling water, and the actual rotational speed Ne of the engine 4. The fan rotational speed N is controlled by adjusting by adjusting the capacity (cc/rev) of the hydraulic pump 18 using the capacity adjusting means 9 (the swash plate driving unit 5 and the electromagnetic proportional control valve 6), thus adjusting the flow rate (l/min) of the hydraulic oil supplied to the hydraulic motor 15.

"Normal control" is control of the temperature of the cooling water to the target temperature by adjusting the fan rotational speed N by adjusting the pump capacity using the capacity adjusting means 9 (the swash plate driving unit 5 and the electromagnetic proportional control valve 6) in accordance with the actual oil temperature Th, the actual temperature Tw of the cooling water, and the actual engine rotational speed Ne. When "normal control" is being implemented, the capacity of the hydraulic pump 18 is controlled (changed) such that the cooling water temperature (fan rotational speed) reaches a target value.

On the other hand, when "reversal processing" (first reversal processing or second reversal processing) is being carried out, the capacity of the hydraulic pump 18 is adjusted to a minimum so that the peak pressure in the oil lines decreases.

Figure 3:
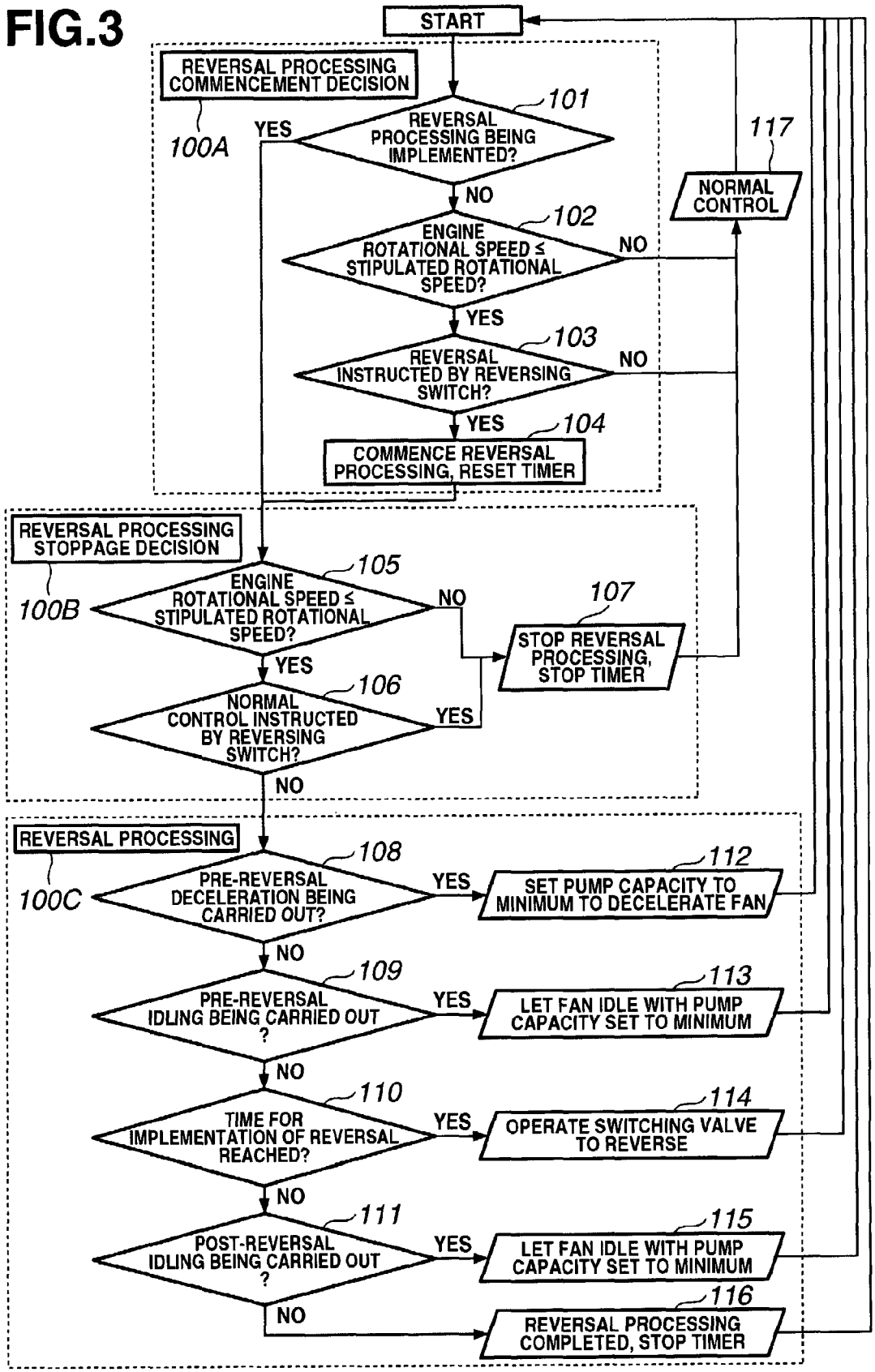
FIG. 3 is a diagram showing the contents of control as a control program according to a working example.

The "reversal processing" is implemented in accordance with the control program shown in FIG. 3.

Following is a description of the contents of the control program for carrying out the "reversal processing", with reference to FIG. 3.

FIRST WORKING EXAMPLE

In this first working example, when the reversing switch 30 is operated so that the reversal processing commencement instruction signal is outputted, control is carried out in which, under the condition that the rotational speed Ne of the engine 4 has decreased to not more than a stipulated rotational speed, the capacity adjusting means 9 is controlled, so as to reduce the capacity of the hydraulic pump 18, and thus reduce the fan rotational speed N, and then the switch position of the switching valve 20 is reversed. Part (a) of FIG. 4 shows the relationship between the time t and the fan rotational speed N in the first working example, and part (b) of FIG. 4 shows transitions between the first reversal processing, normal control, and the second reversal processing on a time chart. That is, upon the control program being started up, reversal processing commencement decision processing 100A (steps 101 to 104) is implemented.

First, it is judged whether or not reversal processing 100C (steps 108 to 116) is currently being implemented (step 101).

In the case that the reversal processing 100C is not currently being implemented (NO at step 101), it is judged whether or not the engine rotational speed Ne is not more than a stipulated rotational speed (e.g. 1000 (r/min)) (step 102).

In the case that the engine rotational speed Ne is not more than the stipulated rotational speed (YES at step 102), next it is judged whether or not the reversing switch 30 has been operated so as to input the reversal processing commencement instruction signal (step 103).

In the case that the reversing switch has been operated so as to input the reversal processing commencement instruction signal (YES at step 103), it is decided that the reversal processing should be commenced, and hence the software timer is reset, and then timing is started (step 104). The software timer is provided for completing the reversal processing within a stipulated time. This is because if the reversal processing were carried out over a long period, then the state of the fan rotational speed N remaining low would continue for a long time, and hence there would be a risk of this bringing about a problem such as the engine 4 overheating.

In this way, when the reversing switch 30 has been operated so as to instruct commencement of the reversal processing, under the condition that the rotational speed Ne of the engine 4 has decreased to not more than the stipulated rotational speed, it is decided that the reversal processing should be commenced. It is thus necessary to teach an operator in advance through an instruction manual, a training course, orders from a supervisor, or the like that "when you wish to carry out reversal processing, you must suspend work, and then operate the engine rotational speed setting instrument 8 so as to reduce the rotational speed of the engine 4 to a stipulated rotational speed". The reason that reducing the engine rotational speed Ne is left to manual operation by the operator is that if the rotational speed of the engine 4 were reduced to not more than the stipulated rotational speed automatically during work, then it might be that the operator is given an incongruous feeling due to the unexpected reduction in the engine rotational speed, resulting in a decrease in the work efficiency.

As shown in part (a) of FIG. 4, if for example one wishes to carry out reversal processing when work is being carried out operating at an engine rotational speed Ne of 2000 rpm, then work is suspended, and the engine rotational speed Ne is reduced to not more than the stipulated rotational speed of 1000 rpm, and then the reversing switch 30 is operated at time t1 so as to instruct commencement of the reversal processing. As a result, it is decided to change over to the first reversal processing.

If, during implementation of the reversal processing commencement decision processing 100A, the engine rotational speed Ne is greater than the stipulated rotational speed (NO at step 102), or the reversing switch 30 is operated again or the like so that the reversal processing commencement instruction signal is not being inputted (NO at step 103), then normal control is implemented (step 117).

Next, under the condition that it has been decided to commence reversal processing (step 104), reversal processing stoppage decision processing 100B (steps 105 to 107) is implemented.

So long as the engine rotational speed Ne is still not more than the stipulated rotational speed (YES at step 105), and the reversing switch 30 has not been operated again or the like so that the reversal processing commencement instruction signal is no longer being inputted (NO at step 106), it is changed over to the subsequent reversal processing 100C.

However, if the engine rotational speed Ne is greater than the stipulated rotational speed (NO at step 105), or the reversing switch 30 is operated again or the like so that the reversal processing commencement instruction signal ceases to be inputted (YES at step 106), then it is not changed over to the reversal processing 100C, but rather it is decided to stop the reversal processing, the timing by the timer is stopped (step 107), and normal control is carried out (step 117).

For example, in the case that one has operated the reversing switch 30, but then reconsiders and decides that one would like to continue work, or realizes that one has made a mistaken operation, the reversal processing can be stopped by increasing the engine rotational speed Ne, or operating the reversing switch 30 again so as to return to normal control.

Next, under the condition that it has not been decided to stop the reversal processing (YES at step 105 and NO at step 106), the reversal processing 100C is implemented.

The reversal processing is carried out in the following stages in accordance with the time measured by the timer. Description will be given with reference to part (a) of FIG. 4.

Pre-Reversal Deceleration

This is processing of decelerating the fan rotational speed N to a desired rotational speed; in terms of the time measured by the timer, 0 up to, for example, 20 seconds is set as the pre-reversal deceleration period (time t1 to t2 in part (a) of FIG. 4). Once the pre-reversal deceleration period is commenced, the capacity adjusting means 9 is controlled, so as to adjust the capacity of the hydraulic pump 18 to a minimum capacity (minimum swash plate angle) (step 112). However, even upon setting the pump capacity to the minimum, because the hydraulically driven cooling fan 13 rotates through inertia, the fan rotational speed N does not decrease to the desired rotational speed immediately, but rather decreases gradually over time. This is why the pre-reversal deceleration period is set.

Pre-Reversal Idling

This is processing for allowing the fan rotational speed N that has been decelerated through the pre-reversal deceleration to settle at the desired rotational speed; in terms of the time measured by the timer, this is set, for example, as a period of 2 seconds (time t2 to t3 in part (a) of FIG. 4) following on from the pre-reversal deceleration period. During the pre-reversal idling period, the capacity of the hydraulic pump 18 is maintained at the minimum capacity (minimum swash plate angle) (step 113). Once the pre-reversal idling period has passed, it is decided that the fan rotational speed N has settled at the desired rotational speed and hence the deceleration has been completed.

Implementation of Reversal (Switching of Switching Valve 20)

Once the pre-reversal idling period has passed, it is decided that a time at which the fan rotational speed N has settled at the desired rotational speed and hence the deceleration has been completed (in terms of the time measured by the timer, after 22 seconds; time t3 in part (a) of FIG. 4) has been reached. At this time that the deceleration has been completed, an electrical control signal for reversing the switching valve 20 is outputted to the electromagnetic solenoid 20*g* of the switching valve 20 (step 114).

Post-Reversal Idling

This is processing of maintaining the fan rotational speed N at the desired rotational speed after the reversal has been implemented; in terms of the time measured by the timer, this is set, for example, as a period of 2 seconds (time t3 to t4 in part (a) of FIG. 4) following on from the implementation of the reversal. During the post-reversal idling period, the capacity of the hydraulic pump 18 is maintained at the minimum capacity (minimum swash plate angle) (step 115). If it were changed over to normal control immediately after the reversal has been implemented, then there would be a risk of the peak pressure rising due to the fan rotational speed increasing. This is why the post-reversal idling period is provided.

Once the time measured by the timer has passed the post-reversal idling period (NO at step 111), it is decided that the reversal processing has been completed, the timing by the timer is stopped (step 116), and the fan rotational speed N is increased to the pre-idling rotational speed (500 rpm) (time t4 to t5 in part (a) of FIG. 4).

In the case that processing of the reversal processing 100C is currently being carried out (step 112, 113, 114, or 115), the reversal processing commencement decision processing 100A is again returned to, and it is judged whether the reversal processing is currently being carried out (step 101); in the case that processing of the reversal processing 100C is currently being carried out (the timer is currently timing) (YES at step 101), it is then changed over to the reversal processing stoppage decision processing 100B as is. As a result, when the reversal processing 100C is being carried out, if one reconsiders and decides that one would like to continue work, or realizes that one has made a mistaken operation, then the reversal processing can be stopped (step 107) by increasing the engine rotational speed Ne (NO at step 105), or operating the reversing switch 30 again (YES at step 106).

After the reversal processing 100C has been completed (step 116), the reversal processing commencement decision processing 100A is again returned to, and it is judged whether the reversal processing 100C is currently being implemented (step 101); in the case that the reversal processing 100C has been implemented (the timing by the timer has stopped) (NO at step 101), it is then changed over to normal control (step 117) upon the engine rotational speed Ne being increased (NO at step 102) or the reversing switch 30 being operated again (NO at step 103).

As shown in parts (a) and (b) of FIG. 4, upon the engine rotational speed Ne being reduced to not more than the stipulated rotational speed of 1000 rpm, and the reversing switch 30 being operated at time t1 so as to give an instruction for the first reversal processing, the first reversal processing is implemented; the fan rotational speed N is decelerated from 500 rpm to a desired low rotational speed (250 rpm) and is settled at this desired low rotational speed (time t1-t2-t3), and then once the time t3 at which the fan rotational speed N has settled at the desired low rotational speed (250 rpm) has been reached, the switching valve 20 is switched from the forward rotation position 20A to the reverse rotation position 20B, so that the hydraulically driven cooling fan 13 rotates in the reverse rotational direction. Because the switch position of the switching valve 20 is reversed in a state in which the hydraulically driven cooling fan 13 is rotating at a low rotational speed in this way, the peak pressure is suppressed. In particular, in the present working example, in addition to the engine rotational speed Ne being reduced, the capacity of the hydraulic pump 18 is also reduced to a minimum, so as to reduce the fan rotational speed N, whereby the amount of reduction of the fan rotational speed N is large, and hence the effect of suppressing the peak pressure is large.

Subsequently, the hydraulically driven cooling fan 13 continues to be rotated in the reverse rotational direction, whereby an air current blowing out rubbish from the radiator 12 is created, and hence rubbish clogging the radiator 12 is blown out.

Note, however, that to effectively blow out the rubbish clogging the radiator 12, the fan rotational speed N is preferably increased.

The operator thus verifies that the direction of rotation of the hydraulically driven cooling fan 13 has been reversed into the reverse rotational direction and changeover to normal control has taken place, and then operates the throttle dial 8 (time t6), so as to increase the fan rotational speed N.

Once it is verified that the work of removing rubbish from the radiator 12 has been completed (time t7), to return the hydraulically driven cooling fan 13 to the original forward rotational direction, the throttle dial 8 is operated (time t7) so as to reduce the engine rotational speed Ne to not more than the stipulated rotational speed (1000 rpm) (time t8), and then the reversing switch 30 is operated again, so as to give an instruction for the second reversal processing. As a result, the second reversal processing is similarly implemented. That is, the fan rotational speed N is decelerated to a desired low rotational speed (250 rpm) and settled at this desired low rotational speed (time t9-t10-t11), and then once the time t11 at which the fan rotational speed N has settled at the desired low rotational speed (250 rpm) has been reached, the switching valve 20 is switched from the reverse rotation position 20B to the forward rotation position 20A, so that the hydraulically driven cooling fan 13 rotates in the forward rotational direction. Because the switch position of the switching valve 20 is reversed in a state in which the hydraulically driven cooling fan 13 is rotating at a low rotational speed in this way, the peak pressure is suppressed. In particular, in the present working example, in addition to the engine rotational speed Ne being reduced, the capacity of the hydraulic pump 18 is also reduced to a minimum, so as to reduce the fan rotational speed N, whereby the amount of reduction of the fan rotational speed N is large, and hence the effect of suppressing the peak pressure is large.

After a post-reversal idling period (time t11-t12), the fan rotational speed N is then increased to the initial rotational speed (500 rpm) (time t13), and changeover to normal control is carried out.

Subsequently, the hydraulically driven cooling fan 13 continues to be rotated in the forward rotational direction, whereby an air current cooling the radiator 12 is created, and hence heat is dissipated from the cooling water passing through the radiator 12.

After verifying that the direction of rotation of the hydraulically driven cooling fan 13 has been reversed into the forward rotational direction (time t14), to carry out normal ground leveling work or the like, the operator then operates the throttle dial 8 again, so as to increase the engine rotational speed Ne to a rotational speed suitable for normal work (2000 rpm).

As described above, according to the present working example, in addition to the engine rotational speed Ne being reduced, the capacity of the hydraulic pump 18 is also reduced to a minimum, so as to sufficiently reduce the fan rotational speed N, and then switching of the switching valve 20 is carried out. As a result, the effect of suppressing the peak pressure is large, and hence even in the case, for example, that the oil temperature is low, the peak pressure can be suppressed sufficiently.

Moreover, according to the present working example, there is no need to separately add a new valve or control apparatus to existing hydraulic circuitry (FIG. 6), and a 2-position switching valve is adequate for the switching valve 220 (FIG. 6) with there being no need to use a 3-position switching valve; it is sufficient to merely modify the control program installed in the controller 24 (which is naturally provided even in an existing system) as shown in FIG. 3. The increase in the apparatus cost can thus be kept to a minimum. Moreover, the engine 4 is of course not stopped during switching of the switching valve 20, and hence there is no burdensomeness of having to restart the engine.

SECOND WORKING EXAMPLE

Figure 2B:
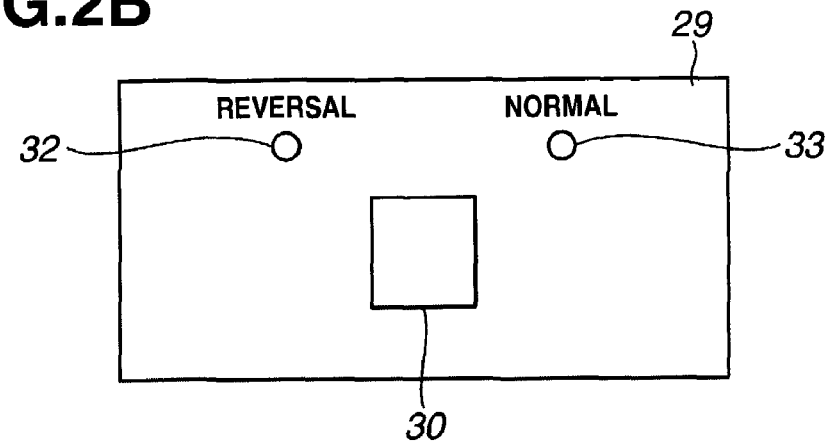

In the first working example described above, description has been given assuming the case that the reversing switch 30 is constructed as a switch for selecting first reversal processing in which the switching valve 20 is switched from the forward rotation position 20A to the reverse rotation position 20B, and second reversal processing in which the switching valve 20 is switched from the reverse rotation position 20B to the forward rotation position 20A, and the controller 24 implements the first reversal processing upon the reversing switch 30 being operated to select the first reversal processing, and implements the second reversal processing upon the reversing switch 30 being operated to select the second reversal processing. However, as shown in FIG. 2B, implementation is also possible in which the reversing switch 30 is constructed as a switch that instructs reversal processing of switching the switching valve 20 from the forward rotation position 20A to the reverse rotation position 20B, and then from the reverse rotation position 20B to the forward rotation position 20A, and upon the reversing switch 30 being operated to instruct the reversal processing, the controller 24 implements reversal processing in which the switching valve 20 is reversed from the forward rotation position 20A to the reverse rotation position 20B, and is then reversed from the reverse rotation position 20B to the forward rotation position 20A.

Note, however, that in this case, out of the control program shown in FIG. 3, the reversal processing 100C portion must be rewritten to reversal processing contents stating "carry out the first reversal processing, then increase the fan rotational speed N for a certain time and carry out processing of removing rubbish from the radiator 12, and then carry out the second reversal processing".

When one wishes to reverse the rotation of the hydraulically driven cooling fan 13 so as to remove rubbish clogging the radiator 12, the engine rotational speed Ne is reduced to not more than the stipulated rotational speed of 1000 rpm. Moreover, the reversing switch 30 on the monitor panel 29 shown in FIG. 2B is operated so as to instruct selection of the reversal processing. As a result, an indicator 32 indicating that selection of the reversal processing has been instructed lights up on the monitor panel 29.

As shown in parts (a) and (c) of FIG. 4, upon the engine rotational speed Ne being reduced to not more than the stipulated rotational speed of 1000 rpm, and the reversing switch 30 being operated at time t1 so as to give an instruction for the reversal processing, first the first reversal processing is implemented. The fan rotational speed N is decelerated from 500 rpm to a desired low rotational speed (250 rpm) and is settled at this desired low rotational speed (time t1-t2-t3), and then once the time t3 at which the fan rotational speed N has settled at the desired low rotational speed (250 rpm) has been reached, the switching valve 20 is switched from the forward rotation position 20A to the reverse rotation position 20B, so that the hydraulically driven cooling fan 13 rotates in the reverse rotational direction. Next, the capacity of the hydraulic pump 18 is increased from the minimum so as to increase the fan rotational speed N (time t4 to t5).

For a certain time from time t4 (t4-t6), processing in which rubbish clogging the radiator 12 is blown out through reverse rotation of the hydraulically driven cooling fan 13 is carried out. At time t6, the second reversal processing is carried out so as to return the hydraulically driven cooling fan 13 to the original forward rotational direction. First, the fan rotational speed N is decelerated to a desired low rotational speed (250 rpm) and is settled at this desired low rotational speed (time t9-t10-t11), and then once the time t11 at which the fan rotational speed N has settled at the desired low rotational speed (250 rpm) has been reached, the switching valve 20 is switched from the reverse rotation position 20B to the forward rotation position 20A.

After verifying that the direction of rotation of the hydraulically driven cooling fan 13 has been reversed into the forward rotational direction (time t13), to carry out normal ground leveling work or the like, the operator then operates the reversing switch 30 again to change over to normal control. As a result, an indicator 33 indicating that selection of normal control has been instructed lights up on the monitor panel 29. Moreover, the operator operates the engine rotational speed setting instrument 8, so as to increase the engine rotational speed Ne to a rotational speed suitable for normal work (2000 rpm).

As described above, according to the present working example, the number of operations of the reversing switch 30 required is low, and hence the burden of manual operation carried out by the operator is reduced.

Moreover, as shown in part (d) of FIG. 4, it may be made to be that upon selection of the reversal processing being instructed using the reversing switch 30, the whole sequence of processing through the reversal processing up to returning to normal control is carried out automatically. In this case, the only manual operations are manually operating the reversing switch 30 once and adjusting the engine rotational speed Ne, and hence the burden of manual operation can be further reduced.

THIRD WORKING EXAMPLE

The lower the oil temperature, the higher the peak pressure becomes, and hence the greater the effect on the durability of the hydraulic equipment, and the greater the effect on the operator.

Accordingly, in the present working example, the controller 24 carries out control such that the lower the oil temperature value Th, the more the rotational speed N of the hydraulically driven cooling fan 13 is reduced at the times when the switch position of the switching valve 20 is reversed (t3 and t8 in part (a) of FIG. 4), whereby the fan rotational speed N is reduced to the minimum required, so that the peak pressure is reduced reliably.

Control must thus be carried out such that the lower the oil temperature Th, the lower the fan rotational speed N at each reversal implementation time (t3 and t8 in part (a) of FIG. 4).

For example, in the case that the oil temperature is a high value Th1, the fan rotational speed required to reduce the peak pressure is a high value N1, and in the case that the oil temperature is a lower value Th2 (<Th1), the fan rotational speed required to reduce the peak pressure is a lower value N2 (<N1).

As the control method for changing the fan rotational speed N in accordance with the oil temperature Th, the following two methods can be envisaged.

First Control Method

The lower the oil temperature Th, the lower the capacity q of the hydraulic pump 18 is adjusted to be.

Second Control Method

The lower the oil temperature Th, the longer is made the deceleration time τ over which the fan rotational speed N of the hydraulically driven cooling fan 13 is reduced from the reversal processing being commenced (the pre-reversal deceleration period; time t1-t2 or t9-t11 in part (a) of FIG. 4).

Out of the control program shown in FIG. 3, in the reversal processing 100C portion, processing for the above first control method or second control method is carried out.

FIG. 5A is a diagram corresponding to part (a) of FIG. 4, and shows the case that the first control method is used.

In the case that the oil temperature Th is a high value Th1, the fan rotational speed N is controlled to be a high value N1 by adjusting the capacity q of the hydraulic pump 18 to a high value q1, and then the reversal is carried out.

On the other hand, in the case that the oil temperature Th is a low value Th2, the fan rotational speed N is controlled to be a low value N2 by adjusting the capacity q of the hydraulic pump 18 to a low value q2 (<q1), and then the reversal is carried out.

FIG. 5B is a diagram corresponding to part (a) of FIG. 4, and shows the case that the second control method is used.

In the case that the oil temperature Th is a high value Th1, the fan rotational speed N is controlled to be a high value N1 by setting the pre-reversal deceleration period τ to be a short period τ1, and then the reversal is carried out.

On the other hand, in the case that the oil temperature Th is a low value Th2, the fan rotational speed N is controlled to be a low value N2 by setting the pre-reversal deceleration period τ to be a long period τ2 (>τ1), and then the reversal is carried out.

FOURTH WORKING EXAMPLE

In the first working example described above, under the condition that the engine rotational speed Ne has decreased to not more than a stipulated rotational speed, the capacity adjusting means 9 is controlled, so as to adjust the capacity of the hydraulic pump 18 to a minimum capacity, and thus reduce the fan rotational speed N, and then switching of the switching valve 20 is carried out.

However, implementation is also possible in which the control of adjusting the capacity of the hydraulic pump 18 is omitted.

That is, control may be carried out in which, upon the reversing switch 30 being operated so as to instruct selection of reversal processing, under the conditions that the engine rotational speed Ne has decreased to not more than a stipulated rotational speed and the rotational speed N of the hydraulically driven cooling fan 13 has decreased, the switch position of the switching valve 20 is reversed.

In this case, in the reversal processing 100C shown in FIG. 3, the control of adjusting the capacity of the hydraulic pump 18 to the minimum capacity is not required.

FIFTH WORKING EXAMPLE

In the first working example described above, under the condition that the engine rotational speed Ne has decreased to not more than a stipulated rotational speed, the capacity adjusting means 9 is controlled, so as to adjust the capacity of the hydraulic pump 18 to a minimum capacity, and thus reduce the fan rotational speed N, and then switching of the switching valve 20 is carried out.

However, implementation is also possible in which the condition that the engine rotational speed Ne has decreased to not more than a stipulated rotational speed is omitted.

That is, control may be carried out in which, upon the reversing switch 30 being operated so as to instruct selection of reversal processing, the capacity adjusting means 9 is controlled, so as to reduce the capacity of the hydraulic pump 18 (e.g. adjust to a minimum capacity), and thus reduce the rotational speed N of the hydraulically driven cooling fan 13, and then the switch position of the switching valve 20 is reversed.

In this case, in the control program shown in FIG. 3, the processing of deciding whether the engine rotational speed Ne is not more than a stipulated rotational speed (steps 102 and 105) is not required.

SIXTH WORKING EXAMPLE

In the first working example described above, upon the reversing switch 30 being operated so as to instruct selection of reversal processing, under the condition that the engine rotational speed Ne has been reduced to not more than a stipulated rotational speed through manual operation by an operator, the capacity adjusting means 9 is controlled, so as to adjust the capacity of the hydraulic pump 18 to a minimum capacity, and thus reduce the fan rotational speed N, and then switching of the switching valve 20 is carried out.

However, implementation is also possible in which the control to reduce the engine rotational speed Ne to not more than the stipulated rotational speed is carried out automatically.

It is considered that if the operator is taught in advance that the engine rotational speed Ne will decrease upon the reversing switch 30 being operated so as to instruct selection of the reversal processing, then it will not be that the operator is given an incongruous feeling due to unexpected reduction in the engine rotational speed, resulting in a decrease in the work efficiency.

That is, in the present working example, upon the reversing switch 30 being operated so as to instruct selection of the reversal processing, control is carried out in which the engine rotational speed adjusting means 7 is controlled, so as to reduce the rotational speed Ne of the engine 4 to not more than a stipulated rotational speed, and moreover the capacity adjusting means 9 is controlled, so as to reduce the capacity of the hydraulic pump 18 (e.g. adjust to a minimum capacity), and thus reduce the rotational speed N of the hydraulically driven cooling fan 13, and then the switch position of the switching valve 20 is reversed.

In this case, in the control program shown in FIG. 3, the processing of deciding whether the engine rotational speed Ne is not more than a stipulated rotational speed (steps 102 and 105) is not required, and instead in the position of this processing there is added a step of controlling the engine rotational speed Ne to be not more than the stipulated rotational speed.

SEVENTH WORKING EXAMPLE

Implementation is also possible in which, in the sixth working example described above, the control of adjusting the capacity of the hydraulic pump 18 is omitted.

That is, in the present working example, upon the reversing switch 30 being operated so as to instruct selection of the reversal processing, control is carried out in which the engine rotational speed adjusting means 7 is controlled, so as to reduce the rotational speed Ne of the engine 4 to not more than a stipulated rotational speed, and thus reduce the rotational speed N of the hydraulically driven cooling fan 13, and then the switch position of the switching valve 20 is reversed.

In this case, in the control program shown in FIG. 3, the processing of deciding whether the engine rotational speed Ne is not more than a stipulated rotational speed (steps 102 and 105) is not required, and moreover in the reversal processing 100C, the control of adjusting the capacity of the hydraulic pump 18 to the minimum capacity is not required; instead, controlling of the engine rotational speed Ne to be not more than the stipulated rotational speed is carried out.

First to seventh working examples have been described above. However, the fourth working example may also be implemented in combination with the second working example or the third working example (second control method), the fifth working example may also be implemented in combination with the second working example or the third working example, the sixth working example may also be implemented in combination with the second working example or the third working example, and the seventh working example may also be implemented in combination with the second working example or the third working example (second control method).

EIGHTH WORKING EXAMPLE

In the first to seventh working examples described above, switching of the switching valve 20 is carried out under the condition that an operator has manually operated the reversing switch 30.

However, even if the operator is taught through an instruction manual, a training course, orders, or the like to "operate the reversing switch 30 periodically so as to remove rubbish clogging the radiator 12", in actual practice there will be many cases in which the reversing switch 30 is not operated due to being busy with ground leveling work, carelessness, or the like.

Implementation is thus also possible in which, regardless of the intentions of the operator, switching of the switching valve 20 is carried out automatically periodically or every time an event occurs.

For example, construction machinery is provided with a service meter that measures operating time, and hence one can envisage implementation in which switching of the switching valve 20 is carried out each time the operating time measured by the service meter reaches a predetermined time.

Moreover, there will be little effect on the operator if the engine rotational speed Ne is reduced, the capacity of the hydraulic pump 18 is reduced, and the switch position of the switching valve 20 is reversed at a work preparation time or a work completion time when the engine is started up or the engine is stopped.

One can thus envisage implementation in which switching of the switching valve 20 is carried out each time an event occurs such as an engine key switch being switched on or the engine key switch being switched off.

In the present working example, operating the reversing switch 30 in the sixth working example described above is further made unnecessary; rather, control is carried out in which, periodically or every time an event occurs, the engine rotational speed adjusting means 7 is controlled, so as to reduce the rotational speed Ne of the engine 4 to not more than a stipulated rotational speed, and moreover the capacity adjusting means 9 is controlled, so as to reduce the capacity of the hydraulic pump 18 (e.g. set the capacity to a minimum capacity), and thus reduce the rotational speed N of the hydraulically driven cooling fan 13, and then the switch position of the switching valve 20 is reversed.

In this case, controlling the engine rotational speed Ne to be not more than a stipulated rotational speed is added to the reversal processing 100C in the control program shown in FIG. 3, and moreover the reversal processing 100C is implemented automatically periodically or every time an event occurs. Note that in the reversal processing 100C, it is preferable to make it such that the whole sequence of reversal processing from implementing the first reversal processing, through increasing the fan rotational speed for a certain time, implementing the second reversal processing, and up to then returning to normal control is carried out automatically.

NINTH WORKING EXAMPLE

Implementation is also possible in which, in the eighth working example described above, the control of adjusting the capacity of the hydraulic pump 18 is omitted.

That is, in the present working example, control is carried out in which, periodically or every time an event occurs, the engine rotational speed adjusting means 7 is controlled, so as to reduce the rotational speed Ne of the engine 4 to not more than a stipulated rotational speed, and thus reduce the rotational speed N of the hydraulically driven cooling fan 13, and then the switch position of the switching valve 20 is reversed.

TENTH WORKING EXAMPLE

Implementation is also possible in which, in the eighth working example described above, the control of reducing the rotational speed Ne of the engine 4 to not more than a stipulated rotational speed is omitted.

That is, in the present working example, control is carried out in which, periodically or every time an event occurs, the capacity adjusting means 9 is controlled, so as to reduce the capacity of the hydraulic pump 18 (e.g. set the capacity to a minimum capacity), and thus reduce the rotational speed N of the hydraulically driven cooling fan 13, and then the switch position of the switching valve 20 is reversed.

Eighth to tenth working examples have been described above. However, the eighth working example may also be implemented in combination with the third working example, the ninth working example may also be implemented in combination with the third working example (second control method), and the tenth working example may also be implemented in combination with the third working example.

ELEVENTH WORKING EXAMPLE

The sixth, seventh, eighth, and ninth working examples described above are working examples in which control is carried out automatically to reduce the rotational speed Ne of the engine 4 to not more than a stipulated rotational speed.

In this case, the stipulated engine rotational speed to be reduced to may be changed, so as to change the fan rotational speed N, in accordance with the oil temperature Th.

That is, similarly to as described with reference to FIGS. 5A and 5B, as shown in FIG. 5C, in the case that the oil temperature Th is a high value Th1, the engine rotational speed Ne is adjusted to a high stipulated rotational speed Ne1, so as to control the fan rotational speed N to a high value N1, and then the reversal is carried out.

On the other hand, in the case that the oil temperature Th is a low value Th2, the engine rotational speed Ne is adjusted to a low stipulated rotational speed Ne2 (<Ne1), so as to control the fan rotational speed N to a low value N2, and then the reversal is carried out.

TWELFTH WORKING EXAMPLE

The implementation in which the switching of the switching valve 20 is carried out manually as described in the first to seventh working examples, and the implementation in which the switching of the switching valve 20 is carried out automatically as described in the eighth to tenth working examples may be carried out selectively.

Figure 2C:
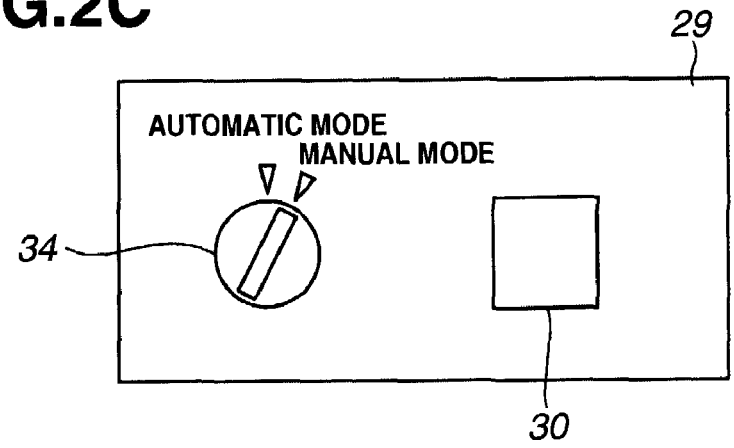

For example, as shown in FIG. 2C, a mode selection switch 34 for selectively switching between "automatic mode" and "manual mode" is provided on the monitor panel 29, and a reversing switch 30 as in FIGS. 2A and 2B is also provided. Upon "manual mode" being selected using the mode selection switch 34, and the reversing switch 30 further being operated to instruct selection of reversal processing, switching of the switching valve 20 is carried out as described in the first to seventh working examples. Moreover, upon "automatic mode" being selected using the mode selection switch 34, switching of the switching valve 20 is carried out periodically or every time an event occurs as described in the eighth to tenth working examples.

Moreover, in each of the working examples, description has been given assuming the case that the switching valve 20 is constructed as a 2-position switching valve having the forward rotation position 20A and the reverse rotation position 20B but not having a neutral position as shown in FIG. 1 so as to reduce cost. However, the present invention can be used with a switching valve 20 having any construction. For example, the present invention can also be used with a 3-position switching valve for which a neutral position is provided between the forward rotation position and the reverse rotation position.

Moreover, in each of the working examples, as shown in FIG. 1, the hydraulic pump 18 is made to be of a variable capacity type, and the fan rotational speed N is reduced by adjusting the capacity of the hydraulic pump 18. However, instead of the hydraulic pump 18, the hydraulic motor 15 may be made to be of a variable capacity type, and the fan rotational speed N may be reduced by adjusting the capacity of the hydraulic pump 18. Furthermore, both the hydraulic pump 18 and the hydraulic motor 15 may be made to be of a variable capacity type, and the fan rotational speed N may be reduced by adjusting the capacity of each of the hydraulic pump 18 and the hydraulic motor 15.

INDUSTRIAL APPLICABILITY

In the above embodiments, the case that the hydraulic circuitry shown in FIG. 1 is installed in construction machinery has been assumed. However, the present invention can also be implemented with the hydraulically driven cooling fan control apparatus of the present invention installed in any other transportation machinery such as a general automobile, or installed in non-transportation machinery.

Further, having described the above embodiments with respect to the accompanying drawings, it is to be understood that the invention is not limited to those precise embodiments, and that various changes and modifications may be effected therein by one skilled in the art without departing from the scope or spirit of the invention as defined in the appended claims.

The invention claimed is:

1. A hydraulically driven cooling fan control apparatus, comprising:

a hydraulic pump that is driven by an engine;

a hydraulic motor that is driven by hydraulic oil ejected from the hydraulic pump, and rotates in a forward rotational direction or a reverse rotational direction in accordance with a direction of the supplied hydraulic oil;

capacity adjusting means for adjusting a capacity of the hydraulic pump or the hydraulic motor;

a hydraulically driven cooling fan that is driven by the hydraulic motor;

a switching valve that has a forward rotation position and a reverse rotation position, and upon being switched to the forward rotation position, supplies the hydraulic oil ejected from the hydraulic pump in a direction corresponding to the forward rotational direction of the hydraulic motor, and upon being switched to the reverse rotation position, supplies the hydraulic oil ejected from the hydraulic pump in a direction corresponding to the reverse rotational direction of the hydraulic motor;

a reversing switch that is operated to reverse a switch position of the switching valve, and outputs a reversal processing commencement instruction signal; and control means for, in response to input of the reversal processing commencement instruction signal, and under a condition that a rotational speed of the engine has decreased to not more than a stipulated rotational speed, controlling the capacity adjusting means, so as to reduce the capacity of the hydraulic pump or the hydraulic motor, and thus reduce a rotational speed of the hydraulically driven cooling fan, and then reversing the switch position of the switching valve.

2. A hydraulically driven cooling fan control apparatus, comprising:

a hydraulic pump that is driven by an engine;

a hydraulic motor that is driven by hydraulic oil ejected from the hydraulic pump, and rotates in a forward rotational direction or a reverse rotational direction in accordance with a direction of the supplied hydraulic oil;

a hydraulically driven cooling fan that is driven by the hydraulic motor;

a switching valve that has a forward rotation position and a reverse rotation position, and upon being switched to the forward rotation position, supplies the hydraulic oil ejected from the hydraulic pump in a direction corresponding to the forward rotational direction of the hydraulic motor, and upon being switched to the reverse rotation position, supplies the hydraulic oil ejected from the hydraulic pump in a direction corresponding to the reverse rotational direction of the hydraulic motor;

a reversing switch that is operated to reverse a switch position of the switching valve, and outputs a reversal processing commencement instruction signal; and control means for, in response to input of the reversal processing commencement instruction signal, and under conditions that a rotational speed of the engine has decreased to not more than a stipulated rotational speed, and a rotational speed of the hydraulically driven cooling fan has decreased to a desired rotational speed, reversing the switch position of the switching valve.

3. A hydraulically driven cooling fan control apparatus, comprising:

engine rotational speed adjusting means for adjusting a rotational speed of an engine;

a hydraulic pump that is driven by the engine;

a hydraulic motor that is driven by hydraulic oil ejected from the hydraulic pump, and rotates in a forward rotational direction or a reverse rotational direction in accordance with a direction of the supplied hydraulic oil;

capacity adjusting means for adjusting a capacity of the hydraulic pump or the hydraulic motor;

a hydraulically driven cooling fan that is driven by the hydraulic motor;

a switching valve that has a forward rotation position and a reverse rotation position, and upon being switched to the forward rotation position, supplies the hydraulic oil ejected from the hydraulic pump in a direction corresponding to the forward rotational direction of the hydraulic motor, and upon being switched to the reverse rotation position, supplies the hydraulic oil ejected from the hydraulic pump in a direction corresponding to the reverse rotational direction of the hydraulic motor; and control means for controlling the engine rotational speed adjusting means, so as to reduce the rotational speed of the engine to not more than a stipulated rotational speed, and controlling the capacity adjusting means, so as to reduce the capacity of the hydraulic pump or the hydraulic motor, and thus reduce a rotational speed of the hydraulically driven cooling fan to a desired rotational speed, and then reversing a switch position of the switching valve.

4. The hydraulically driven cooling fan control apparatus according to claim 3, characterized in that the control means carries out control such that a value of the desired rotational speed of the hydraulically driven cooling fan is further reduced as an oil temperature value becomes lower.

5. The hydraulically driven cooling fan control apparatus according to claim 4, characterized in that the control means adjusts the stipulated rotational speed of the engine to a lower value as the oil temperature value becomes lower.

6. A method for controlling a hydraulically driven cooling fan that is rotationally driven by supplying hydraulic oil from a hydraulic pump having an engine as a driving source to a hydraulic motor via a switching valve, the hydraulically driven cooling fan control method, comprising:

a step of, upon an instruction for reversing a switch position of the switching valve being given, and under a condition that a rotational speed of the engine is not more than a stipulated rotational speed, adjusting a capacity of the hydraulic pump or the hydraulic motor, so as to reduce the capacity of the hydraulic pump or the hydraulic motor, and thus reduce a rotational speed of the hydraulically driven cooling fan; and a step of, once the rotational speed of the hydraulically driven cooling fan has been reduced to a desired rotational speed, reversing the switch position of the switching valve.

7. A method for controlling a hydraulically driven cooling fan that is rotationally driven by supplying hydraulic oil from a hydraulic pump having an engine as a driving source to a hydraulic motor via a switching valve, the hydraulically driven cooling fan control method, comprising:

a step of, upon an instruction for reversing a switch position of the switching valve being given, adjusting a rotational speed of the engine so as to reduce the rotational speed of the engine to not more than a stipulated rotational speed, and adjusting a capacity of the hydraulic pump or the hydraulic motor, so as to reduce the capacity of the hydraulic pump or the hydraulic motor, and thus reduce a rotational speed of the hydraulically driven cooling fan; and a step of, once the rotational speed of the hydraulically driven cooling fan has been reduced to a desired rotational speed, reversing the switch position of the switching valve.

* * * * *